United States Patent [19]

Adams

[11] 4,244,121

[45] Jan. 13, 1981

[54] WATERPROOF BOOT WITH KNEE PROTECTION

[75] Inventor: Richard R. Adams, Rock Island, Ill.

[73] Assignee: Chromalloy American Corporation, St. Louis, Mo.

[21] Appl. No.: 898,700

[22] Filed: Apr. 21, 1978

[51] Int. Cl.[3] ..... A43B 1/10

[52] U.S. Cl. ..... 36/2 R; 36/4; 12/142 F

[58] Field of Search ..... 36/2 R, 1.5, 4, 109; 2/22; 12/142 F

[56] References Cited

U.S. PATENT DOCUMENTS

| | | | |
|---|---|---|---|
| 984,608 | 2/1911 | Roberts | 36/2 R |
| 1,061,740 | 5/1913 | Gehant | 36/109 |
| 1,223,297 | 4/1917 | Stewart . | |
| 1,524,049 | 1/1925 | Martin | 36/4 |
| 1,555,202 | 9/1925 | Hannis | 36/4 X |
| 1,620,743 | 3/1927 | Stuart | 36/2 R |
| 1,892,300 | 12/1932 | DeWitt | 36/2 R |
| 2,054,958 | 9/1936 | Tousley | 36/1.5 |
| 2,455,801 | 12/1948 | Olson | 36/4 |
| 2,473,099 | 6/1949 | Hatch | 36/1.5 X |
| 2,697,886 | 12/1954 | Spinali . | |
| 3,744,158 | 7/1973 | Walker | 36/1.5 |
| 3,827,167 | 8/1974 | Jones | 36/4 |

FOREIGN PATENT DOCUMENTS

| | | | |
|---|---|---|---|
| 304988 | 1/1929 | United Kingdom | 36/4 |

*Primary Examiner*—James Kee Chi

*Attorney, Agent, or Firm*—Le Blanc, Nolan, Nies & Kurz

[57] ABSTRACT

A waterproof hip length boot and method of manufacture wherein the fabric lined upper leg portion is attached as a sheet around its lower edge to the upper edge of the lower boot portion by an adhesive such as urethane or another synthetic polymeric material having similar properties that provides circumferential and longitudinal bonded seams and also coats the fabric opposite the wearer's knee for internal abrasion protection.

7 Claims, 4 Drawing Figures

WATERPROOF BOOT WITH KNEE PROTECTION

This invention relates to the construction of waterproof boots particularly heavy duty boots such as are worn by firemen, with special protection for the knee of the wearer.

The invention will be described in its preferred embodiment which comprises boots that are of about hip length and within which the knee of the wearer may rub against the inner lining of the boot during walking or running.

In the invention the upper leg portion is bonded to the lower portion of the boot by an adhesive material that also extends over the usual lining of the upper leg portion to provide a materially reduced abrasion area opposite the wearer's knee, and this is a major object of the invention.

Preferably the boot is constructed by assembling two prefabricated portions, the lower portion being formed to conventionally accomodate the foot and lower leg and the upper portion as a prefabricated laminated rubber and fabric sheet which is wrapped around the upper edge of the lower boot portion after coating one side edge and a bottom edge of its fabric side with an adhesive that also extends upwardly within the upper portion of the boot sufficiently to provide a protective buffer for the knee of the wearer, and this is an important object of the invention.

Pursuant to the foregoing phase of the invention the adhesive is preferably a viscous urethane or other polymer liquid spread over the fabric lining of the sheet in the necessary areas.

It is a major object of the invention to provide a hip length waterproof boot wherein the inner lining is substantially continuously fabric or felt except for a smooth low abrasion area opposite the wearer's knee. Pursuant to this object the low abrasion area is provided by an extension to that area of a liquid adhesive coating that bonds the foot and lower leg portion of the boot to the upper portion.

Further objects of invention will appear as the description proceeds in connection with the appended drawings and claims.

PREFERRED EMBODIMENTS

Figure 1:
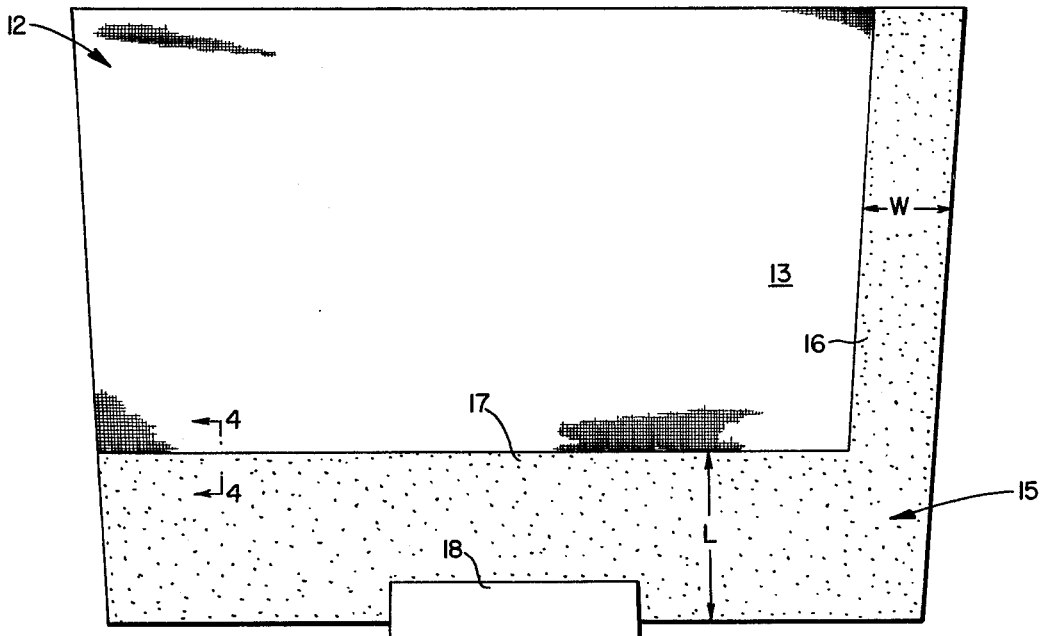
FIG. 1 is an exploded view showing construction of a waterproof boot according to a preferred embodiment of the invention.

FIG. 1 shows a lower portion 11 of the boot, and the prefabricated flexible sheet 12 which is to be attached to comprise the upper leg portion of the boot.

The lower portion of the boot which contains the foot and lower leg may be fabricated in any known manner, preferably comprising an inner lining of felt externally covered by a layer or layers of rubber. Insulation, toe protectors, metatarsal guards and other intermediate parts may be built into the boot according to known practice. In any event the lower boot portion 11 is built to substantially complete form and its external surface is rubber or a like synthetic plastic.

Figure 3:
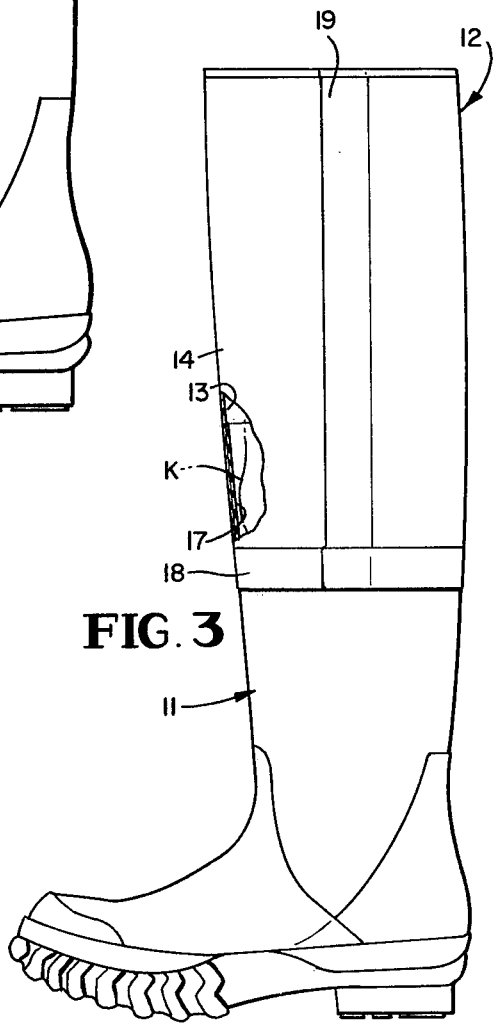
FIG. 3 is a side elevation of a finished boot broken away and sectioned to show the knee protection area.

The boot is completed to the form shown in FIG. 3 by prefabricating the sheet 12 and attaching it to the lower portion 11.

Figure 4:
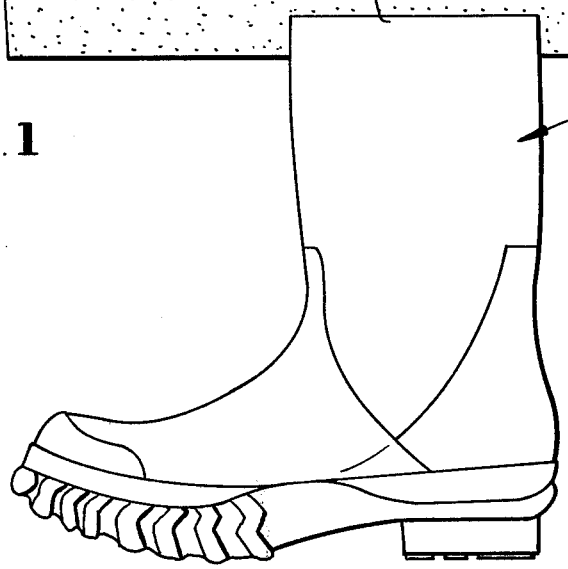
FIG. 4 is a fragmentary section on line 4—4 of FIG. 1.
Figure 4:
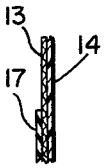
Figure 2:
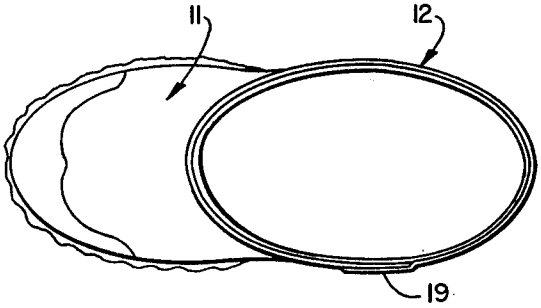
FIG. 2 is a top plan view of the boot of FIG. 1.

The prefabricated sheet 12 is laminated and preferably comprises an inner lining 13 of fabric and an external covering 14 of rubber or equivalent synthetic plastic which also may be the same as the external coating of the lower portion 11. Multiple layers may be incorporated but the innermost and outermost layers are as shown at 13 and 14 in FIG. 4.

The sheet 12 is now coated on the fabric side with an area 15 of liquid adhesive material part of which also extends to serve as an internal knee protective buffer as will appear.

The area 15 may advantageously be L-shaped with a relatively narrow longitudinal band 16 extending along a side edge of the sheet and a wider lateral band 17 preferably continuous with the lower end of band 16 extending across the bottom side of the sheet.

In the drawing sheet 12 is shown in FIG. 1 as disposed so that the lower edge of band 17 will overlap in a significant but narrow circumferential seam at 18 around the upper edge of the boot lower portion, so that as the sheet 12 is wrapped around the boot, essentially about a vertical axis, the lower edge of the sheet will adhesively bond upon the lower boot portion. The sheet 12 is of sufficient width that when it wraps around the boot lower portion the side edges adhesively overlap and bond in a vertical seam as shown at 19 in FIG. 3. The dimensions are preferably such that the seam is of the width W shown in FIG. 1 whereby the interior of the upper leg portion will present a continual fabric lining, except as will appear below.

The vertical width of band 17 indicated at L in FIG. 1 is such that the area coated with the adhesive material extends upwardly sufficiently within the boot that it may be contacted by the flexing knee K of the wearer as indicated in FIG. 3. After the upper and lower portions of the boot are adhesively joined and seam 19 is formed the assembly is subjected to a vulcanizing operation which completes the bonding. This may be preceded by spraying a protective and decorative spray of urethane over the assembly.

Preferably the adhesive coating of bands 16 and 17 is formed by spreading urethane in viscous liquid form over the corresponding areas of the fabric whereby the urethane impregnates the fabric in those areas to improve the bond with the lower boot portion and at the seam.

The upper part of urethane band 17 when dry provides an internal smooth low friction tough flexible abrasion resistant surface region for contacting the wearer's knee, thereby contributing to the comfort and safety of the wearer. Urethane is preferred because it bonds tightly and provides an exposed smooth but soft and rubbery feeling surface cover in the knee contact area and it may be built up in thickness as described. Any equivalent material which will provide these functions and will not deteriorate when the assembly is vulcanized may be used.

While urethane is the preferred material, it is within the scope of the invention to employ any other synthetic polymeric material having equivalent adhesive and other of the foregoing characteristics and properties.

It has also been found that the reenforcement provided by band 17 reduces and smooths out wrinkles and folds in the knee area as the upper portion is folded down over the lower portion and thereby provides for longer life of the boot.

Band 17 at least about the edge of the lower boot portion may be thicker than band 16 to increase the protective buffer action in the knee area, thereby providing added impact protection as well as abrasion protection.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a boot of the type wherein a relatively flexible upper leg portion is secured upon a foot and lower leg portion around a circumferential seam, the improvement wherein said portions are adhesively secured at said seam by an adhesive layer that extends integrally upwardly from said seam at least within the forward part of said upper leg portion to provide when dry a flexible smooth tough internal reduced abrasion area directly opposite the wearer's knee.

2. In the boot defined in claim 1, said layer being thicker in said area opposite the wearer's knee than in said seam, for impact protection.

3. In the boot defined in claim 1, said upper portion comprising a fabric lined rubber sheet coated with said adhesive on the fabric side in contiguous bands along a side edge and its lower edge on the lining side and wrapped around the upper part of said lower portion so that the bottom of said lower edge band is disposed within said circumferential seam, the upper part of said lower edge band forms said reduced abrasion area and the side edges of the sheet are overlapped in a vertical seam with said side edge band between them.

4. The boot defined in claim 1, said adhesive being a layer or layers of synthetic polymeric material.

5. In the boot defined in claim 3, said adhesive being a layer or layers of urethane or other equivalent polymer.

6. In a boot of the type wherein a flexible fabric lined laminated fabric and rubber upper leg portion extends upwardly from a lower foot and lower leg portion lined with felt, the improvement wherein said portions are adhesively combined around a circumferential seam at the upper end of said lower leg portion by a continuous layer of synthetic polymeric adhesive material that extends as a coating over the fabric lining of said upper leg portion to provide when dry an internal fixed layer of flexible tough abrasion resistant material in the area directly opposite the wearer's knee.

7. In the boot defined in claim 5, said layer being of urethane or other equivalent polymer.

* * * * *